US007047844B1

(12) United States Patent
Macor

(10) Patent No.: US 7,047,844 B1
(45) Date of Patent: May 23, 2006

(54) MULTI-SOCKET WRENCH

(76) Inventor: Richard J. Macor, 26 Alpaugh Dr., Asbury, NJ (US) 08802

( * ) Notice: Subject to any disclaimer, the term of this patent is extended or adjusted under 35 U.S.C. 154(b) by 779 days.

(21) Appl. No.: 09/361,330

(22) Filed: Jul. 27, 1999

(51) Int. Cl.
*B25B 13/06* (2006.01)

(52) U.S. Cl. ..... 81/124.4; 81/57.5; 81/124.5; 81/125.1

(58) Field of Classification Search ..... 81/124.5, 81/57.5, 416, 124.4, 125.1; 411/389, 383, 411/432, 433, 338, 339
See application file for complete search history.

(56) References Cited

U.S. PATENT DOCUMENTS 1,194,792 A * 8/1916 Stewart
1,485,571 A * 3/1924 Stevens
2,154,012 A * 4/1939 Rhodes
2,210,048 A * 8/1940 Swanson
2,609,069 A * 9/1952 McLaughlin
3,602,074 A * 8/1971 Smith
5,557,992 A * 9/1996 Macor

* cited by examiner

*Primary Examiner*—D. S. Meislin
(74) *Attorney, Agent, or Firm*—Kenneth P. Glynn

(57) ABSTRACT

A multi-socket wrench is described which includes an elongated main member having a thickness dimension with an upper area, a lower area, a first end and a second end; and, at least two elongated wrench units, e.g. four wrench units. Each wrench unit has a thickness dimension and opposing elongated ends and two sockets positioned side by side thereon. One of the at least two wrench units is rotatably attached at the upper area and another of the at least two wrench units is rotatably attached at the lower area of the first end of the elongated main member. The present invention wrench further includes an attachment means for rotatably attaching two wrench units at a time, to the elongated main member. The attachment means includes an attachment member having a thickness dimension and two fasteners each having a head with a thickness dimension. In other embodiments the attachment means includes an attachment member having a thickness dimension and only one fastener having a head with a thickness dimension.

16 Claims, 3 Drawing Sheets

FIG. 6
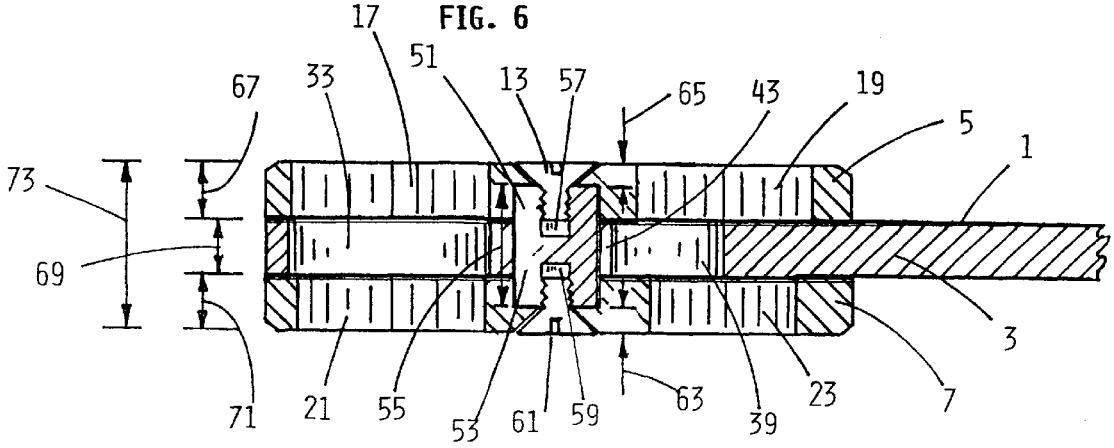
FIG. 7
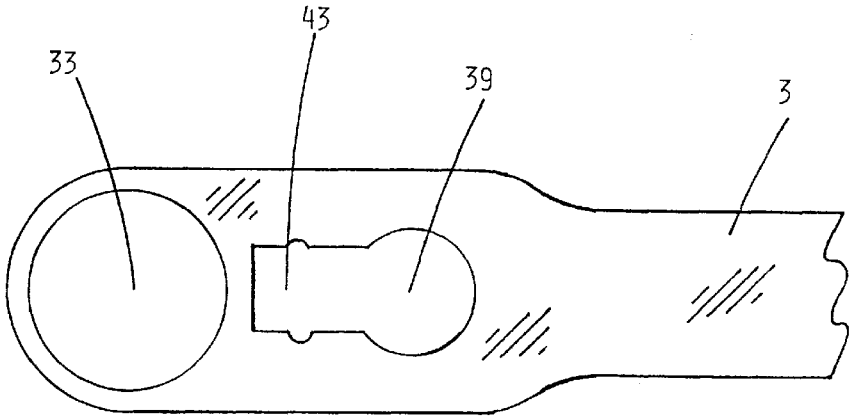
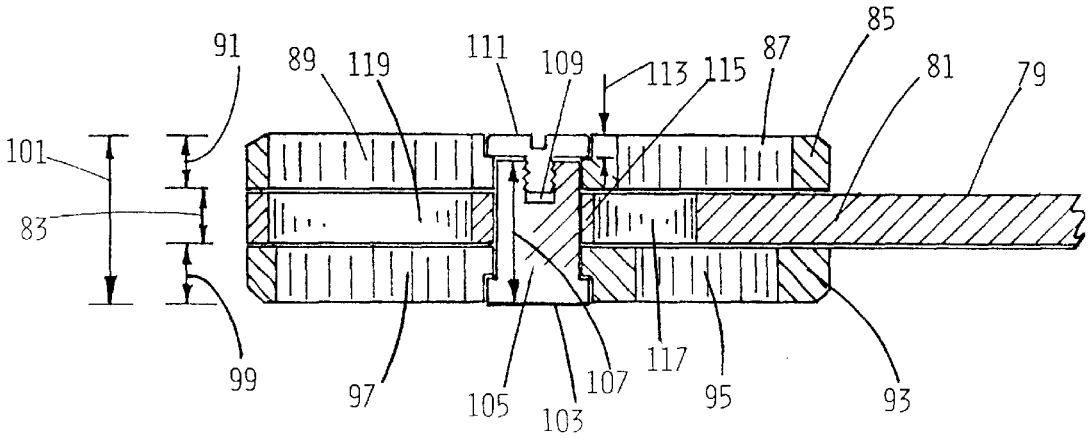
FIG. 8

MULTI-SOCKET WRENCH

REFERENCES TO RELATED APPLICATIONS

This application relates to U.S. Pat. No. 5,557,992, filed by the inventor herein and entitled MULTI-SOCKET WRENCH CONTAINING DUAL SOCKET WRENCH UNITS.

FIELD OF THE INVENTION

The present invention relates to hand tools, particularly wrenches and most particularly wrenches having multiple size capabilities. The present invention involves a "multi-socket" wrench which has multiple sockets of different sizes.

BACKGROUND OF THE INVENTION

Over the years there have been numerous wrenches developed which have multiple size capabilities.

For example, an adjustable open end wrench has a fixed jaw member and a movable jaw member which is adjustable to engage with many different size fasteners. This type of wrench requires a large wrench head for strength purposes which limits its access to fasteners during many commonly encountered situations; and, this wrench requires working room sufficient for the wrench to swing and turn 60 degrees to be operable. In addition, this type of "open end" adjustable wrench is much weaker than a closed end or "box" type wrench. Accordingly, open end wrenches frequently slip upon the fastener being turned resulting in fastener deformation and wrench wear.

An adjustable "box" type wrench has a fixed jaw member and a movable jaw member which is adjustable to engage with many different size fasteners. This type of wrench also requires a large wrench head for strength purposes which limits its access to fasteners during many commonly encountered situations; and, this wrench also requires working room sufficient for the wrench to swing and turn 60 degrees to be operable.

There have been many other known wrenches developed having multiple size capabilities including those with multiple sockets, however, most have proven to be commercially unsuccessful because of the disadvantages specified above, and or, they were too complex and costly to produce.

SUMMARY OF THE INVENTION

The present invention involves a multi-socket wrench, which comprises an elongated main member having a thickness dimension with an upper area, a lower area, a first end and a second end; and, at least two elongated wrench units, e.g. four wrench units. Each wrench unit has a thickness dimension and opposing elongated ends and two sockets positioned side by side thereon. One of the at least two wrench units is rotatably attached at the upper area and another of the at least two wrench units is rotatably attached at the lower area of the first end of the elongated main member. The present invention wrench further includes an attachment means for rotatably attaching two wrench units at a time, to the elongated main member. The attachment means includes an attachment member having a thickness dimension and two fasteners each having a head with a thickness dimension. In some embodiments, the present invention includes wrench units at both the first end and the second end. In the same or other embodiments the attachment means includes an attachment member having a thickness dimension and only one fastener having a head with a thickness dimension.

The present invention was developed recognizing the need for a wrench with multiple size capabilities that could access and turn fasteners during actual, commonly encountered situations. The ability to access and turn fasteners under commonly encountered situations requires that the wrench have a relatively small, efficient and streamline head design.

Accordingly, it is an important objective of the present invention described herein that it have multiple size capability.

It is another objective of the present invention that the wrench head be relatively small and efficient in design without protruding fasteners or hardware so that it can access and turn fasteners during commonly encountered situations.

It is another objective of the present invention that it be operable when there is less than 60 degrees working room to swing and turn the wrench.

It is another objective of the present invention that it have a strong design to reduce potential slippage between wrench and fastener; and, It is another objective of the present invention that it be commercially viable, simple in design and cost-efficient to manufacture.

BRIEF DESCRIPTION OF THE DRAWINGS

The present invention is more fully understood when the specification herein is taken in conjunction with the drawings appended hereto, wherein:

FIG. 6 shows a left side, cut view of a portion of the present invention wrench shown in FIGS. 1 through 5, illustrating an attachment means for two wrench units;

FIG. 7 shows a top partial view of the elongated main member of the previously shown present invention wrench, illustrating the locking slot; and, FIG. 8 shows a side, cut view of a portion of another present invention wrench, illustrating another attachment means for two wrench units.

DETAILED DESCRIPTION OF THE DRAWINGS

Figure 1:
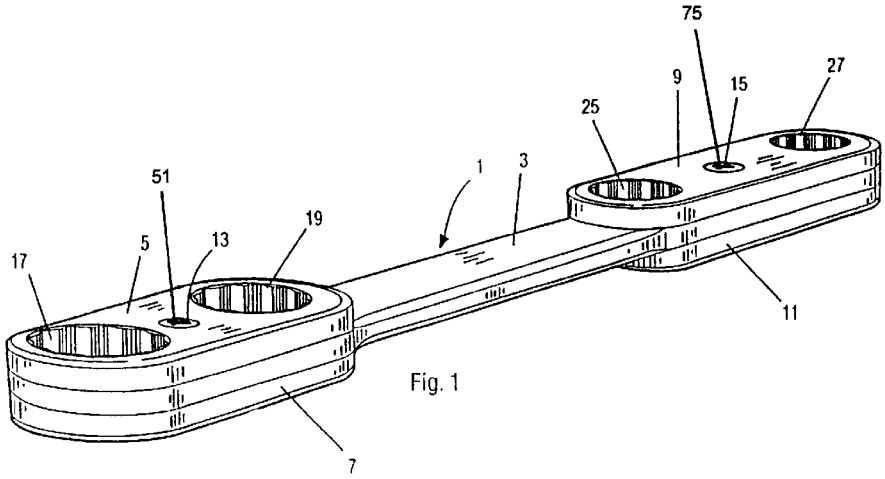
FIG. 1 shows a side oblique of a present invention wrench.
Figure 2:
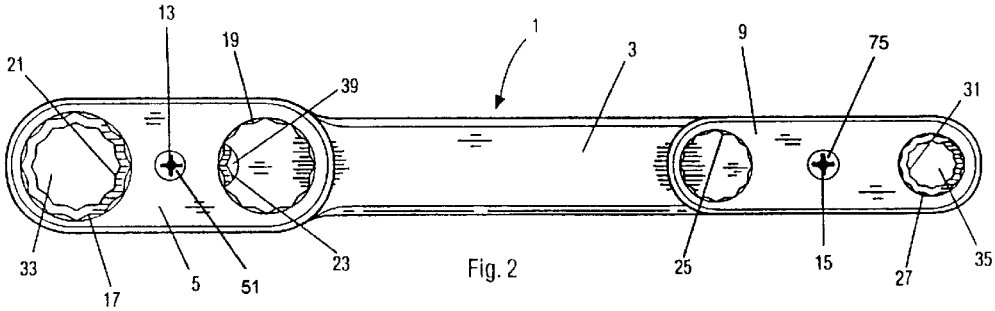
FIGS. 2 and 3 show top and bottom views thereof, respectively.
Figure 3:
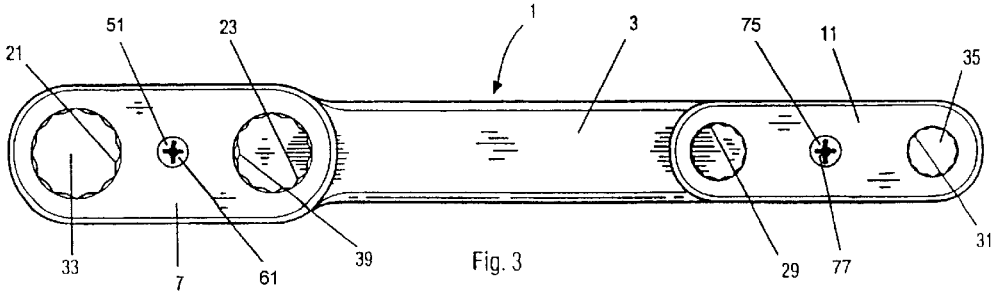

Referring to FIGS. 1, 2 and 3 simultaneously, there is shown in FIG. 1 an obligue side view of present invention multi-socket wrench 1, and this is shown in its top view in FIG. 2 and its bottom view in FIG. 3. There is an elongated main member 3, as shown. There is wrench unit 5 and wrench unit 7 located on the left end of elongated main member 3. Both wrench units 5 and 7 are attached to elongated main member 3 by attachment means 51 which includes fastener screw 13 shown in FIGS. 1 and 2, and fastener screw 61 shown in FIG. 3. Fastener screws 13 and 61 are components of attachment means 51 and rotatably attach wrench units 5 and 7 to elongated main member 3. Likewise at the opposite side of elongated main member 3 is wrench unit 9 on the top and wrench unit 11 on the bottom. Both wrench units 9 and 11 are attached to elongated main member 3 by attachment means 75 which includes fastener screw 15 shown in FIGS. 1 and 2, and fastener screw 77 shown in FIG. 3. Fastener screws 15 and 77 are components of attachment means 75 and rotatably attach wrench units 9 and 11 to elongated main member 3. Thus, each of wrench units 5, 7, 9 and 11 are arranged so as to rotate clockwise or counterclockwise upon elongated main member 3.

Wrench unit 5 includes a first socket size 17 and a second socket size 19, and wrench unit 7 has a third socket size 21 and a fourth socket size 23. These are clearer in FIGS. 2 and 3. Likewise, wrench unit 9 has a fifth socket size 25 and a sixth socket size 27 and, finally, wrench unit 11 has a seventh socket size 29 and an eighth socket size 31, as shown. The sockets 17, 19, 21, 23, 25, 27, 29 and 31 may be of any size or any combination of sizes but are preferably arranged in an order that would make up a set of wrenches or sockets. For example, a preferred sizing arrangement may be ¾, 11/16, ⅝, 9/16, ½, 7/16, " and 5/16 inches. Also, if the socket openings were to be of the 12 point design shown here, multi-socket wrench 1 would require only 30 degrees of access room to swing and be operable, providing it a significant advantage over all adjustable (open end or box) type wrenches.

Elongated main member 3 includes orifices 33 and 35 to provide for maximum usage of the present invention multi-socket wrench 1. Also shown in FIGS. 2 and 3 is round portion 39 of a locking slot discussed further in conjunction with FIGS. 6 and 7 below.

Figure 4:
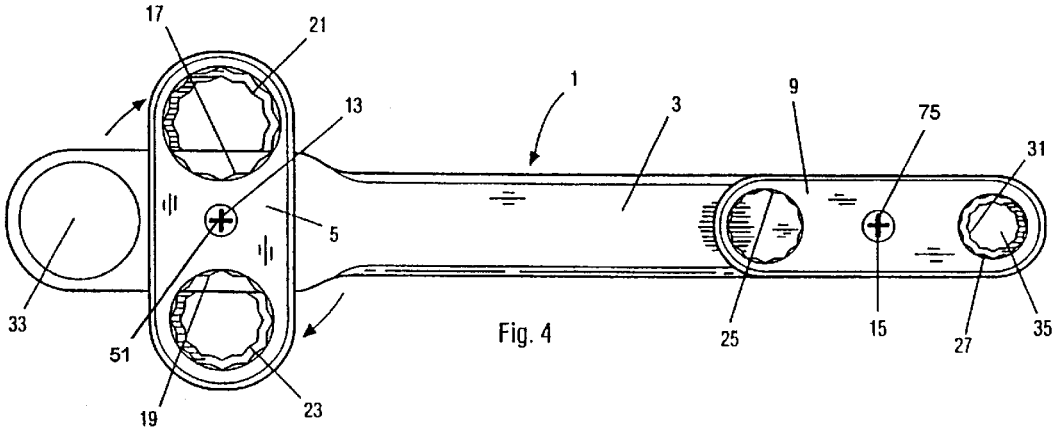
FIGS. 4 and 5 show top views of the wrench shown in FIGS. 1 through 3, but with one of the wrench units being rotated to alter the work position of the sockets thereon.
Figure 5:
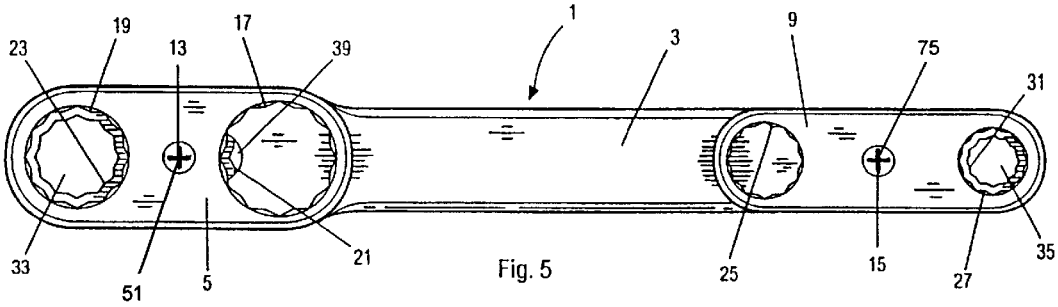

Referring now to FIGS. 4 and 5, there are shown top views of multi-socket wrench 1, as shown in FIG. 2, with identical parts, identically numbered. Here, however, wrench units 5 and 7 are rotated in a clockwise manner as represented by the arrows in FIG. 4. As can be seen, the wrench units 5 and 7 are rotated together and thus, first size socket 17 is positioned (after rotation) on the inside, i.e. toward the mid portion of elongated main member 3 instead of the outside, and second socket size 19 ends up positioned on the outside. Likewise, third socket size 21 also ends up located on the inside of elongated main member 3 instead of the outside, and fourth socket size 23 ends up on the outside. In other words, through the rotation of wrench units 5 and 7, it can be seen by comparing FIGS. 2 and 5 that the two sockets 17 and 19 have been juxtapositioned and the two sockets 21 and 23 have been juxtapositioned. Likewise, wrench units 9 and 11 can be rotated accordingly, and the result is that any of the eight different socket sizes available on this wrench 1 may be positioned to the outside of elongated main member 3 so as to rest over opening 33 or 35 as shown, to engage with and turn a fastener.

FIG. 6 shows a left side, cut view of a portion of the present invention wrench shown in FIGS. 1 through 5. Attachment means 51 includes attachment member 53 and screw fasteners 13 and 61. Attachment member 53 has a thickness dimension represented by dimension 55 and two threaded orifices 57 and 59 for screws 13 and 61 respectively. In this embodiment shown, attachment means 51 serves several purposes; first, it is used to connect wrench units 5 and 7 together so as to provide simultaneous rotation of both wrench units together; and second, it is used to attach both wrench units 5 and 7 to elongated main member 3; and third, it provides for the locking and or free rotation of both wrench units depending on the positioning of the attachment means relative to the elongated main member 3. In addition, attachment means 51 serves all the above mentioned purposes without protruding from wrench 1, thus, providing for a wrench head that is relatively small, streamline and efficient in design. As mentioned earlier, this is important so that multi-socket wrench 1 can access and turn various fasteners under frequently encountered situations where there is little access or clearance around the fastener.

Since this FIG. 6 shows a left side, cut view of the same wrench shown in previous views, all components shown here that are in the previous views are numbered the same as in previous views. Also shown in this view is a locking slot with a locking portion 43 and round portion 39, and component dimensions. Dimensions 67, 69, 71 and 73 are shown, whereas, dimension 67 represents the thickness of wrench unit 5; and, dimension 69 represents the thickness of elongated main member 3; and, dimension 71 represents the thickness of wrench unit 7. The total combined thickness of wrench unit 5, elongated main member 3 and wrench unit 7 together is represented by dimension 73. Dimensions 55, 63 and 65 are shown, whereas, dimension 55 represents the thickness of attachment member 53; and, dimension 63 represents the head thickness of screw 61; and, dimension 65 represents the head thickness of screw 13. To maximize efficiency and operation of wrench 1, preferred embodiments of the present invention have dimensions such that the total combined thickness of elongated main member 3 and both wrench units 5 and 7 which include dimensions 69, 67 and 71 respectively, is equal to or greater than the total combined thickness of attachment member 53 and the heads of both fasteners 13 and 61 which includes dimensions 55, 65 and 63 respectively. In other preferred embodiments of the present invention like that of wrench 1 shown in this view, the total combined thickness of elongated main member 3 and both wrench units 5 and 7 which includes dimensions 69, 67 and 71 respectively, is about equal to the total combined thickness of attachment member 53 and the heads of both fastener 13 and 61 which includes dimensions 55, 65 and 63 respectively. Again, this is important so that multi-socket wrench 1 has a wrench head that is relatively small, streamline and efficient in design. This allows wrench 1 to access and turn various fasteners during frequently encountered situations where there may little access or clearance around the fastener. Although the dimensions and components are shown for the left side of wrench 1 in this FIG. 6, the components, dimensions and relationships are also applicable to the other side of wrench 1 not shown in this view, and other embodiments of the present invention.

Fasteners 13 and 61 could be almost any type of fastener which "fastens" wrench units 5 and 7 to attachment member 53 and elongated main member 3. The fasteners could be threaded or otherwise. They could also be rivets which would minimize manufacturing labor. If rivets were used, threaded orifices 57 and 59 would probably not be threaded, but only orifices to accommodate the rivets and the fastening process.

FIG. 7 shows a top partial view of elongated main member 3 of the previously shown present invention wrench 1, illustrating the locking slot having a round portion 39 for the free rotation of attachment member 53 and thus the attached wrench units for changing to different sockets, and locking portion 43 formed here as a rectangle for securing the rotation of attachment member 53 and thus the wrench units. Accordingly, attachment means 53 shown in FIG. 6 has a block shape with at least two outer surfaces being parallel each other so as to fit within and cooperate with locking portion 43 to secure the rotation of the wrench units 5 and 7 during the turning of fasteners. An attachment member having at least two outer surfaces being parallel each other provides for the locking of attachment member 53 and, thus, the locking of wrench units 5 and 7 during use and the turning of various fasteners. This same arrangement is used at the other side of wrench 1 which is not shown in this view.

FIG. 8 shows a left side, cut view of a portion of another present invention, multi-socket wrench. This wrench, like the other wrench previously shown has four wrench units with eight different sockets, of which, two wrench units and four sockets are shown in this view. Multi-socket wrench 79 has elongated main member 81 with a thickness dimension 83 and orifice 119. Rotatably attached at the upper area of main member 81 is wrench unit 85 having socket 87 and 89 and thickness dimension 91. Rotatably attached at the lower area of main member 81 is wrench unit 93 having sockets 95 and 97 and a thickness dimension 99. Dimension 101 represents the total combined thickness of elongated main member 81 and wrench units 85 and 87 which includes dimensions 83, 91 and 99 respectively. Attachment means 103 comprises attachment member 105 and threaded orifice 109 for screw type fastener 111. Attachment member 105 has a thickness dimension 107 and the head of screw 111 has a thickness dimension 113. In this embodiment shown, attachment means 103 serves several purposes; first, it is used to connect wrench units 85 and 93 together so as to provide simultaneous rotation of both wrench units together; and second, it is used to attach both wrench units 85 and 93 to elongated main member 81; and third, it provides for the locking and or free rotation of both wrench units depending on the positioning of the attachment means 103 relative to locking portion 115 and or rotating portion 117 of elongated main member 3. In addition, attachment means 103 serves all the above mentioned purposes while providing for a wrench head that is relatively small, streamline and efficient in design. As mentioned earlier, this is important so that multi-socket wrench 79 can access and turn various fasteners under frequently encountered situations where there is little access or clearance around the fastener. To maximize efficiency and operation of multi-socket wrench 79, preferred embodiments of the present invention have dimensions such that the total combined thickness of elongated main member 81 and both wrench units 85 and 93 which includes dimensions 83, 91 and 99 respectively, is equal to or greater than the total combined thickness of attachment member 105 and the head of screw fastener 111 which includes dimensions 107 and 113 respectively. In other preferred embodiments of the present invention like that of wrench 79 shown in this view, the total combined thickness of elongated main member 81 and both wrench units 85 and 93 which includes dimensions 83, 91 and 99 respectively, is about equal to the total combined thickness of attachment member 105 and the head of screw fastener head 111 which includes dimensions 107 and 113 respectively. Again, this is important so that multi-socket wrench 79 has a wrench head that is relatively small, streamline and efficient in design. This allows wrench 79 to access and turn various fasteners during frequently encountered situations where there may little access or clearance around the fastener.

Regarding FIGS. 6 and 8, it is important to note that specifics about the different attachment means including their dimensional relationships to secure the wrench units, have not been disclosed previously through writing or illustration in applicant's related issued U.S. Pat. No. 5,557,992.

Upon reading and understanding the specification of the present invention described above, modifications and alterations will become apparent to those skilled in the art. It is intended that all such modifications and alterations be included insofar as they come within the scope of the patent as claimed or the equivalence thereof.

Having thus described the invention, the following is claimed:

1. A multi-socket wrench, which comprises:

an elongated main member having a thickness dimension with an upper area, a lower area, a first end and a second end; and, at least two elongated wrench units, each wrench unit having a thickness dimension and opposing elongated ends, and each wrench unit having two sockets being positioned side by side thereon, one of said at least two wrench units being rotatably attached at said upper area and another of said at least two wrench units being rotatably attached at said lower area of said first end of said elongated main member; and, attachment means for rotatably attaching two of said wrench units to said elongated main member, said attachment means being separate components from said elongated main member and said at least two elongated wrench units, said attachment means comprising an attachment member having a thickness dimension and two fasteners each having a head, each head having a thickness dimension;

wherein the total combined thickness of said elongated main member and both wrench units, is equal to or greater than the total combined thickness of said attachment member and both fastener heads.

2. The multi-socket wrench of claim 1, wherein the total combined thickness of said elongated main member and both wrench units, is about equal to the total combined thickness of said attachment member and both fastener heads.

3. The multi-socket wrench of claim 1, wherein said attachment member has at least two outer walls that are substantially parallel each other.

4. The multi-socket wrench of claim 1, wherein said attachment member has a threaded orifice at both ends thereof, and said two fasteners are threaded screws.

5. A multi-socket wrench of claim 1, wherein said attachment member has an orifice at both ends thereof, and said two fasteners are rivets with heads.

6. A multi-socket wrench of claim 2, wherein said attachment member has at least two outer walls that are substantially parallel each other.

7. A multi-socket wrench of claim 2, wherein said attachment member has a threaded orifice at both ends thereof, and said two fasteners are threaded screws.

8. A multi-socket wrench of claim 2, wherein said attachment member has an orifice at both ends thereof, and said two fasteners are rivets with heads.

9. A multi-socket wrench which comprises:

an elongated main member having a thickness dimension with an upper area, a lower area, a first end and a second end; and, at least two elongated wrench units, each wrench unit having a thickness dimension and opposing elongated ends, and each wrench unit having two sockets being positioned side by side thereon, one of said at least two wrench units being rotatably attached at said upper area and another of said at least two wrench units being rotatably attached at said lower area of said first end of said elongated main member; and, attachment means for rotatably attaching two of said wrench units to said elongated main member, said attachment means being separate components from said elongated main member and said at least two elongated wrench units, said attachment means comprising an attachment member having a thickness dimension and one fastener having a head, said head having a thickness dimension;

wherein the total combined thickness of said elongated main member and both wrench units, is equal to or greater than the total combined thickness of said attachment member and fastener head.

10. The multi-socket wrench of claim 9, wherein the total combined thickness of said elongated main member and both wrench units, is about equal to the total combined thickness of said attachment member and fastener head.

11. The multi-socket wrench of claim 9, wherein said attachment member has at least two outer walls that are substantially parallel each other.

12. The multi-socket wrench of claim 9, wherein said attachment member has a threaded orifice at one end thereof, and said fastener is a threaded screw.

13. The multi-socket wrench of claim 9, wherein said attachment member has an orifice at one end thereof, and said fastener is a rivet.

14. The multi-socket wrench of claim 10, wherein said attachment member has at least two outer walls that are substantially parallel each other.

15. The multi-socket wrench of claim 10, wherein said attachment member has a threaded orifice at one end thereof, and said fastener is a threaded screw.

16. The multi-socket wrench of claim 10, wherein said attachment member has an orifice at one end thereof, and said fastener is a rivet with a head.

* * * * *